US009990842B2

(12) United States Patent
Zribi et al.

(10) Patent No.: US 9,990,842 B2
(45) Date of Patent: Jun. 5, 2018

(54) LEARNING ALARMS FOR NUISANCE AND FALSE ALARM REDUCTION

(71) Applicant: Carrier Corporation, Farmington, CT (US)

(72) Inventors: Anis Zribi, Farmington, CT (US); Stan Burnette, Farmington, CT (US); Bill Chandler, Farmington, CT (US)

(73) Assignee: Carrier Corporation, Farmington, CT (US)

( * ) Notice: Subject to any disclaimer, the term of this patent is extended or adjusted under 35 U.S.C. 154(b) by 0 days. days.

(21) Appl. No.: 14/722,363

(22) Filed: May 27, 2015

(65) Prior Publication Data

US 2015/0348400 A1 Dec. 3, 2015

Related U.S. Application Data

(60) Provisional application No. 62/006,997, filed on Jun. 3, 2014.

(51) Int. Cl.

| | |
|---|---|
| ***G08B 29/00*** | (2006.01) |
| ***G08B 29/18*** | (2006.01) |
| *G08B 17/00* | (2006.01) |
| *G08B 21/14* | (2006.01) |

(52) U.S. Cl.

CPC ..... *G08B 29/185* (2013.01); *G08B 17/00* (2013.01); *G08B 21/14* (2013.01)

(58) Field of Classification Search

CPC ..... G08B 21/18; G08B 25/008; G08B 3/10; G08B 17/10; G08B 29/185; G08B 21/182; G08B 19/005; G08B 5/36; G08B 21/02; G08B 21/14

USPC ..... 340/508, 540, 501

See application file for complete search history.

(56) References Cited

U.S. PATENT DOCUMENTS 4,707,795 A * 11/1987 Alber ..... G01R 31/3606 324/433
5,499,030 A * 3/1996 Wicks ..... G01S 7/292 342/159
5,581,242 A * 12/1996 Arita ..... G05B 23/0272 340/404.1

(Continued)

FOREIGN PATENT DOCUMENTS

| | | | |
|---|---|---|---|
| CN | 102855726 | A | 1/2013 |
| CN | 103310576 | A | 9/2013 |
| EP | 1389331 | A1 | 2/2004 |

*Primary Examiner* — Joseph Feild
*Assistant Examiner* — Rufus Point
(74) *Attorney, Agent, or Firm* — Locke Lord LLP; Scott D. Wofsy; Judy R. Naamat

(57) ABSTRACT

A learning alarm includes a sensor operatively connected to a processor to detect environmental properties and an alarm operatively connected to the processor to provide an alert if the environmental properties are outside an acceptable range. A user interface is operatively connected to the processor to accept user input indicating an alert corresponds to a nuisance condition. A memory is also operatively connected to the processor for storing detected environmental properties corresponding to the nuisance condition. The processor is configured to suppress alerts from the alarm based on detected environmental properties corresponding to the environmental properties of the nuisance condition stored in the memory.

17 Claims, 3 Drawing Sheets

(56) References Cited

U.S. PATENT DOCUMENTS 5,691,703 A 11/1997 Roby et al.
5,831,524 A 11/1998 Tice et al.
6,154,142 A 11/2000 Kosugi et al.
6,204,768 B1 3/2001 Kosugi et al.
6,462,652 B1 * 10/2002 McCuen ..... G08B 25/10 340/3.1
6,535,124 B1 * 3/2003 DiTommaso ..... F02C 9/00 123/294
6,597,288 B2 7/2003 Amano et al.
6,856,246 B2 2/2005 Chicca
6,927,394 B2 8/2005 Parham et al.
7,126,467 B2 10/2006 Albert et al.
7,161,481 B2 1/2007 Turner
7,170,418 B2 1/2007 Rose-Pehrsson et al.
7,639,128 B2 12/2009 Kogan et al.
7,786,877 B2 8/2010 Hou
7,805,002 B2 9/2010 Privalov
7,952,474 B2 5/2011 Kang et al.
7,991,187 B2 8/2011 Hou
8,064,722 B1 11/2011 Rose-Pehrsson et al.
8,098,156 B2 1/2012 Caler et al.
8,203,438 B2 * 6/2012 Kiani ..... A61B 5/1455 340/286.07
8,553,664 B2 * 10/2013 Bansal ..... H04L 41/0823 370/338
8,963,730 B1 * 2/2015 Dickerman ..... G08B 21/185 340/636.1
8,988,232 B1 * 3/2015 Sloo ..... G01N 27/02 340/602
9,068,432 B2 * 6/2015 Chapman ..... E21B 44/00
9,279,794 B2 * 3/2016 Tolmie ..... G01N 33/0006
9,411,494 B2 * 8/2016 Baker, Jr. ..... A61M 16/0051
2002/0130782 A1 * 9/2002 Johnston ..... G08B 17/10 340/628
2002/0154009 A1 * 10/2002 McCuen ..... G08B 25/10 340/501
2004/0055359 A1 * 3/2004 Ketler ..... G01N 33/0006 73/1.07
2008/0129497 A1 * 6/2008 Woodard ..... G08B 25/08 340/540
2008/0272902 A1 * 11/2008 Kang ..... G08B 29/183 340/506
2008/0277586 A1 * 11/2008 Cardinale ..... G01M 3/002 250/339.13
2009/0222224 A1 * 9/2009 Lewis ..... H02S 50/10 702/64
2010/0102136 A1 * 4/2010 Hadzidedic ..... F24F 11/0079 236/49.3
2010/0102948 A1 * 4/2010 Grohman ..... G05B 23/027 340/506
2012/0154152 A1 * 6/2012 Rantala ..... A61B 5/02455 340/573.1
2012/0293334 A1 11/2012 Yu et al.
2013/0271286 A1 10/2013 Quan et al.
2014/0277612 A1 * 9/2014 Justin ..... G05B 23/0291 700/80
2014/0361885 A1 * 12/2014 Szudajski ..... H04L 41/0883 340/508
2016/0007290 A1 * 1/2016 Lindemann ..... H04M 1/72569 370/311

* cited by examiner

LEARNING ALARMS FOR NUISANCE AND FALSE ALARM REDUCTION

CROSS-REFERENCE TO RELATED APPLICATION

This application claims the benefit of priority under 35 U.S.C. § 119(e) to U.S. Provisional Application No. 62/006,997, filed Jun. 3, 2014, which is incorporated herein by reference in its entirety.

BACKGROUND OF THE INVENTION

1. Field of the Invention

The present invention relates generally to individual alarms and alarm systems. More specifically, the present invention relates to alarms and alarm systems, e.g., for detecting hazards in residential, commercial and industrial applications such as smoke, toxic or explosive gases.

2. Description of Related Art

There has been remarkable growth in the usage of home smoke detectors, principally single-station, battery-operated, ionization-mode smoke detectors. This rapid growth, coupled with clear evidence in actual fires and fire statistics of the lifesaving effectiveness of detectors, made the home smoke detector a fire safety success.

In recent years, however, studies of the operational status of smoke detectors in homes revealed that as many as one-fourth to one-third of smoke detectors are nonoperational at any one time. Over half of the nonoperational smoke detectors are attributable to missing batteries. The rest is due to dead batteries and nonworking smoke detectors. Research showed the principal cause of the missing batteries was homeowner's frustration over nuisance alarms, which are caused not by accidental, unwanted fires but by controlled fires, such as cooking flames. These nuisance or false alarms are also caused by nonfire sources, such as steam emanating from a bathroom shower, dust or debris stirred up during cleaning, or oil vapors escaping from a kitchen.

Centralized fire detection systems also play an important role in protecting the occupants of commercial and industrial buildings. False alarms are detrimental in this setting as well, not only causing inconvenience to building occupants but also potentially creating a dangerous lack of confidence in the validity of future alarms.

Smoke alarms are equipped with hush buttons which simply allow a user to temporarily reduce the alarm sensitivity during a nuisance or false alarm event. However, it is common for the hush button to have to be pressed repeatedly during a single nuisance event. It is possible that the user may decide to disable the alarm altogether rather than deal with nuisance alarms.

Such conventional methods and systems have generally been considered satisfactory for their intended purpose. However, there is still a need in the art for improved device and method for reducing false alarms. The present disclosure provides a solution for this need.

SUMMARY OF THE INVENTION

In one aspect of the invention a learning alarm includes a sensor operatively connected to a processor to detect environmental properties and an alarm operatively connected to the processor to provide an alert if the environmental properties are outside an acceptable range. A user interface is operatively connected to the processor to accept user input indicating an alert corresponds to a nuisance condition. A memory is also operatively connected to the processor for storing detected environmental properties corresponding to the nuisance condition. The processor is configured to suppress alerts from the alarm based on detected environmental properties corresponding to the environmental properties of the nuisance condition stored in the memory.

The processor can be configured to compare the detected environmental properties with environmental properties from a plurality of stored nuisance conditions. The processor can also be operative to override suppression of the alerts in the presence of environmental properties outside of a predetermined range.

In certain embodiments, the nuisance condition includes a property selected from the group consisting of gas concentration, gas composition, humidity, and temperature. The nuisance condition may also include smoke concentration and composition.

In another aspect of the invention a learning alarm system includes a processor operatively connected to at least two alarm units. Each alarm unit includes a sensor to detect environmental properties. An alarm is operatively connected to the processor to provide an alert if the environmental properties are outside an acceptable range. A user interface is operatively connected to the processor to accept user input indicating an alert corresponds to a nuisance condition. A memory is operatively connected to the processor for storing detected environmental properties corresponding to the nuisance condition detected from each alarm. The processor is configured to suppress alerts from the alarm based on detected environmental properties corresponding to the environmental properties of the nuisance condition stored in the memory.

A control panel can be operatively connected to the processor for monitoring the at least two alarms.

A method of suppressing nuisance alarms is also provided. The method first includes detecting a condition. Next, the detected condition is compared with at least one nuisance condition stored in memory. An alert is provided if the condition is outside an acceptable range and if the condition does not correspond to a nuisance condition. In addition, the alert is suppressed if the condition corresponds to a nuisance condition.

In certain embodiments the method can include accepting user input to indicate the condition is a nuisance condition and storing the nuisance condition in memory. The method can also include overriding suppression of the alert when the condition is outside a predetermined range.

It is also contemplated that the step of comparing can include comparing a slope of a curve of the detected condition and a slope of a curve of the at least one nuisance condition. The step of comparing may also include comparing a rate of rise of the detected condition and a rate of rise of the at least one nuisance condition. The step of comparing may further include comparing a shape of a curve of the detected condition and a shape of a curve of the at least one nuisance condition using curve fitting techniques.

In other embodiment, the condition includes a property selected from the group consisting of gas concentration, gas composition, humidity, and temperature. The condition may also include smoke concentration and composition.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
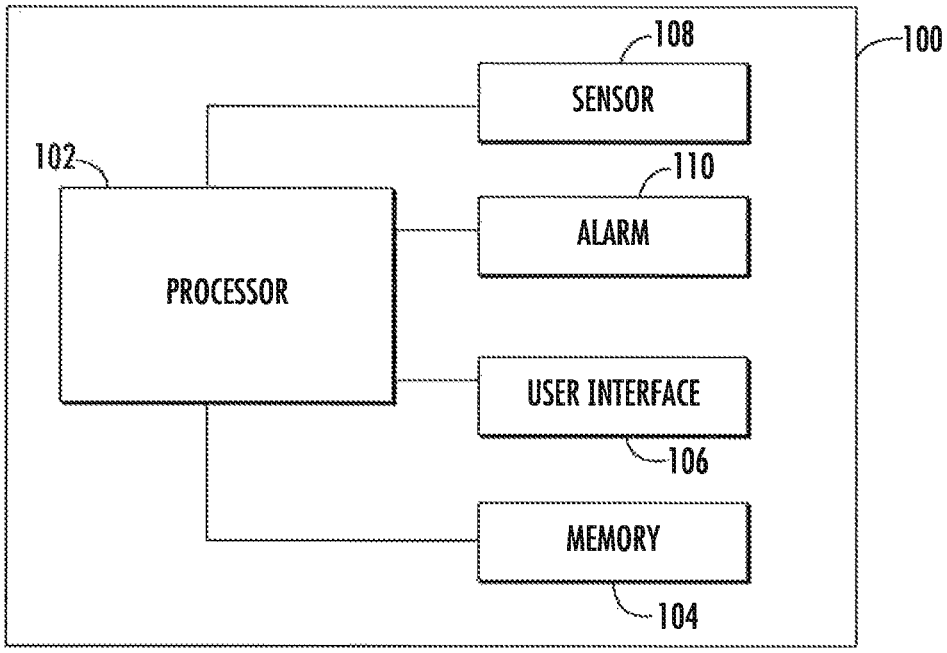
FIG. 1 is a schematic view of an exemplary embodiment of a learning alarm constructed in accordance with the present disclosure.

Reference will now be made to the drawings wherein like reference numerals identify similar structural features or aspects of the subject disclosure. For purposes of explanation and illustration, and not limitation, a partial view of an exemplary embodiment of the learning alarm in accordance with the disclosure is shown in FIG. 1 and is designated generally by reference character 100. Other embodiments of learning alarms in accordance with the disclosure, or aspects thereof, are provided in FIGS. 2-3, as will be described. The systems and methods described herein can be used to diminish the occurrence of alerts from alarms during nuisance events.

With reference to FIG. 1, a learning alarm 100 in accordance with the present invention is shown schematically. The learning alarm 100 utilizes a processor 102 and a memory 104 working in conjunction to diminish the occurrence of nuisance events/false alarms over time. Several smoke detectors can be installed in a residential space to alert the occupants when a relatively high amount of smoke is detected, for example. However, in many instances, the smoke may be the result of a safe, controlled activity, in other words, the alert under such conditions is a false alarm. False alarms can be caused by cooking flames, a spike in heat and humidity due to steam from a shower and/or dust or debris circulated during cleaning, or the like. In traditional alarms, to stop the alert of the smoke detector, the occupant has to silence the alarm manually or in extreme cases dismantle the smoke detector.

The learning alarm 100 of the present invention stores the characteristics of the false alarm/nuisance event in real time. When a nuisance event occurs, a user silences the learning alarm 100 through a user interface 106, e.g., by pressing a hush button. The memory 104 of the alarm 100 stores characteristics of detected properties, e.g., smoke properties, at the time the nuisance event occurs.

The alarm 100 has a sensor 108 operatively connected to the processor 102 to detect environmental properties. It is to be understood that the sensor is shown and described to detect various environmental properties, for example, $CO_2$ gas concentrations, which are generally associated with fires. The sensor 108 may also be associated with detecting temperature, humidity, and smoke concentration and composition. It is also contemplated that the systems and methods described herein can be adapted to non-smoke application such as in CO alarms for hazardous gases.

Once the sensor 108 detects environmental properties outside an acceptable range, an alarm 110 operatively connected to the processor alerts the occupant of the detected hazard. In instances when the alarm 110 issues an alert during controlled circumstances constituting a nuisance alert, the occupant silences the alarm through the user interface 106 operatively connected to the processor 102 indicating the alarm was activated during a nuisance condition. The memory 104 operatively connected to the processor stores the detected environmental properties corresponding to the nuisance condition. More specifically, the memory 104 stores the environmental concentration and characteristics detected over a period of time as a waveform with the increase and decrease in environmental parameter concentration.

At a later time when the sensor 108 detects environmental properties, the processor 102 is configured to suppress alerts from the alarm 110 based on detected environmental properties corresponding to the environmental properties of the nuisance condition stored in memory 104. Over time a plurality of nuisance condition characteristics will accumulate in the memory 104. The processor 102 will compare each occurrence of hazard detection by the sensor 108 with a plurality of the nuisance conditions to suppress alerts when the detected environmental properties correspond to a known nuisance condition.

Figure 2:
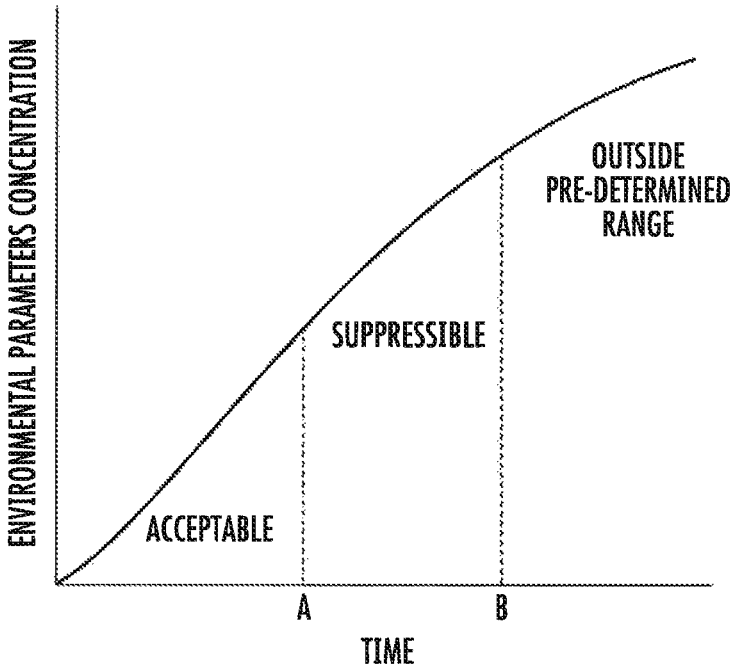
FIG. 2 is a graphical representation of suppressible and non-suppressible environmental parameters concentration ranges detected using the learning alarm of FIG. 1.

In addition, the processor is operative to override suppression of alerts in the presence of environmental properties outside of a pre-determined range. For example, if the detected property lies outside of a pre-determined safe range the alert suppression will be over-ridden by the processor and an alert will issue. FIG. 2 illustrates graphically ranges in which the alert can be suppressed either via user input or after comparison to a stored nuisance condition and when the alert is overridden. As shown in FIG. 2 as the environmental parameters concentration increases past an acceptable range, the alert can be suppressed either via user input or after comparison to a stored nuisance event. However, once the environmental parameters concentration increases past a pre-determined safe range, suppression of the alert is overridden and the alarm will sound. In this manner, alarm 100 learns to discriminate between real hazardous conditions and a nuisance event. This significantly lowers the frequency of false alarms/nuisance events and the associated likelihood that an occupant will disable the alarm entirely. FIG. 1 illustrates the alarm 100 schematically, however it will be understood that the features of alarm 100 can be included in a housing, similar to smoke detectors as known in the art.

Figure 3:
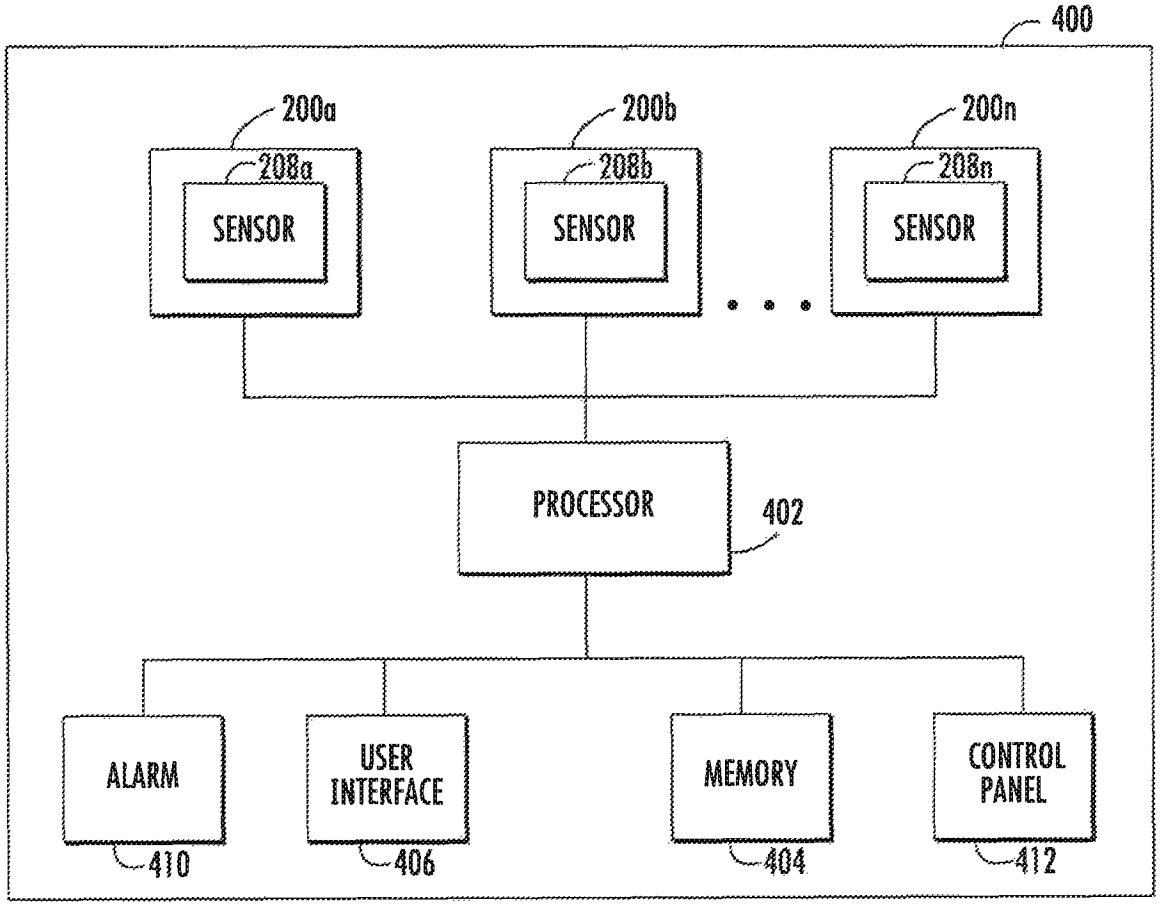
FIG. 3 is a schematic view of learning alarm system having two learning alarm units of FIG. 1.

With reference now to FIG. 3, an alarm system 400, is shown for use. The system 400 has at least two alarms 200*a*, 200*b* in a residential, commercial or industrial building, or the like. As shown in FIG. 2, each alarm 200*a*, 200*b* has a sensor 208*a*, 208*b* to detect environmental properties within the vicinity of the individual sensor 208*a*, 208*b*. Each sensor 208*a*, 208*b* is operatively connected to the processor 402. In addition, an alarm 410 to provide an alert, a user interface 406 to accept user input, and a memory 404 to store detected environmental properties are operatively connected to a processor 402. The processor 402 is operatively connected to a control panel 412, e.g., a central panel for controlling and monitoring sensors throughout a large building. In this system 400 when a nuisance condition is identified with sensor 208*a*, the alert can be suppressed through the control panel 412. The characteristics of the nuisance condition are stored in memory 404. If an environmental property is later detected at sensor 208*b*, the characteristics are compared to the plurality of nuisance conditions stored in memory 404. Thus, a nuisance condition sensed by sensor 208*a* will cause suppression of the alarm 410 if a similar nuisance condition is sensed by sensor 208*b*. In other words, the stored characteristics of nuisance conditions in memory 404 from each sensor 208*a*, 208*b* are used to determine if a subsequently sensed environmental parameter concentration is within an acceptable range. This further provides a greater database of nuisance condition characteristics to diminish nuisance events. To allow system 400 to learn which conditions correspond to a nuisance condition, a user can provide hush input at panel 412 whenever a nuisance condition arises, such as described above in FIG. 1.

Figure 4:
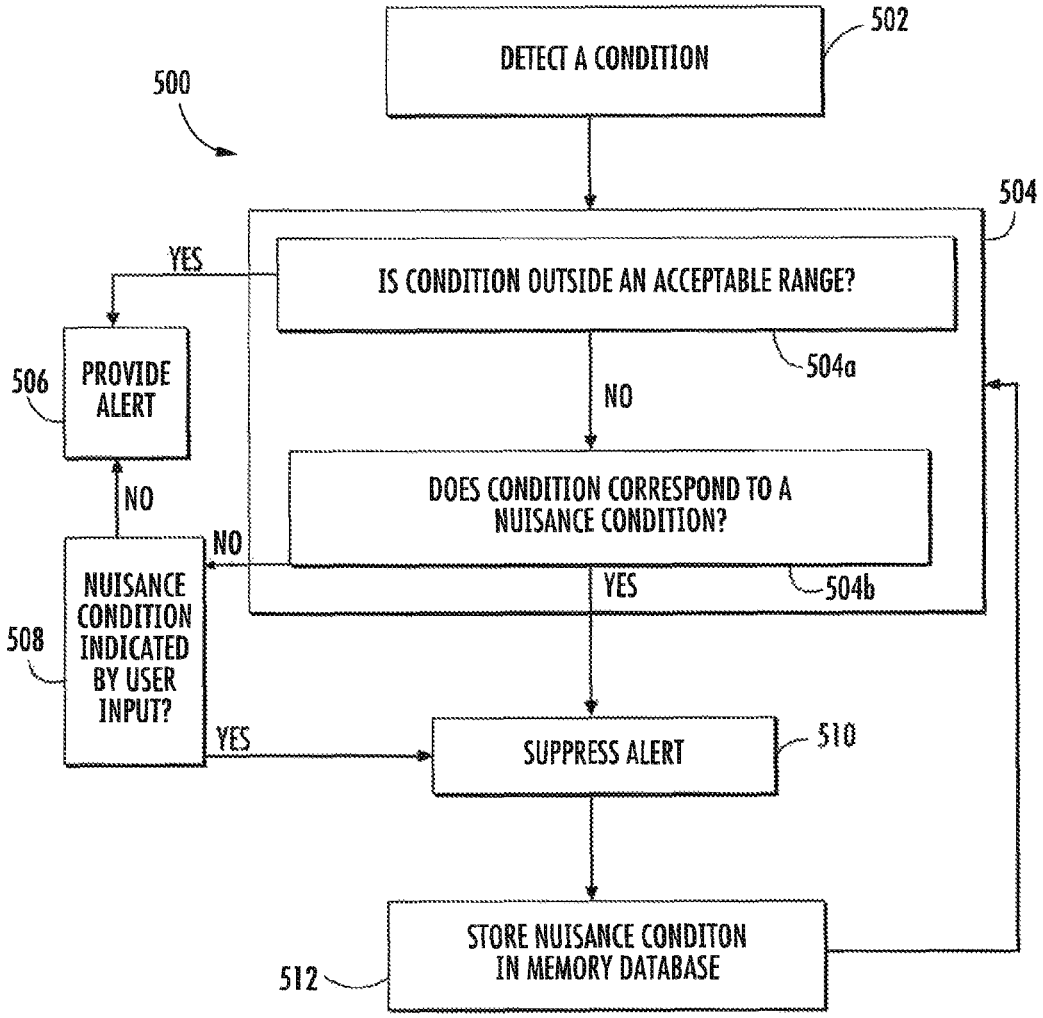
FIG. 4 is a flow chart showing the method of suppressing nuisance alarms using the learning alarm of FIG. 1.

FIG. 4 illustrates a method 500 of suppressing alarms during a nuisance condition using the learning alarm 100 of FIG. 1. The method steps comprise first detecting a condition at step 502. The condition includes gas concentration or composition, particle concentration or composition, humidity, and temperature.

The detected condition is next compared at step 504 with conditions outside an acceptable range 504*a*. If the condition is outside an acceptable range then the alert will be provided at step 506. If the detected condition is within an acceptable range, the condition is compared with at least one nuisance condition stored in memory, e.g., memory 104, 504*b*. If the detected condition does correlate to a stored nuisance condition, the alert is suppressed in step 510.

When the detected condition does not correlate with at least one stored nuisance condition, a processor, e.g., processor 102, determines if the alert was suppressed by user input 508. If yes, the alert is suppressed at step 510. If no, the alert is provided at step 506.

At step 512 when the condition is suppressed either because of user input or by comparison to stored nuisance conditions, memory stores the real-time nuisance condition. Memory 104 stores each nuisance condition as a waveform indicating the increase and decrease of the detected concentration and atmospheric characteristics detected over a period of time. The step of comparing includes comparing the slope of the curve of the detected condition and the slope of the curve of the at least one nuisance condition. The step of comparing may also include comparing the rate of rise of the detected condition and the rate of rise of the at least one nuisance condition. Those skilled in the art will appreciate that the method depicted in FIG. 3 can readily be adapted to the system 400 shown in FIG. 2 as well.

The methods and systems of the present disclosure, as described above and shown in the drawings, provide for a learning alarm with superior properties including a learning alarm that can discriminate between real hazardous conditions and a nuisance event. This significantly lowers the frequency of false alarms/nuisance events and the associated likelihood that an occupant will disable the alarm entirely.

While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A learning alarm, comprising:

a processor;

a sensor operatively connected to the processor to detect environmental properties;

an alarm operatively connected to the processor to provide an alert if environmental properties are outside an acceptable range, including at least one first environmental property detected at a first time associated with a first alert;

a user interface operatively connected to the processor to accept user input indicating that the first alert corresponds to a nuisance condition; and a memory operatively connected to the processor for storing in response to receipt of the user input the at least one first environmental property as nuisance environmental properties that correspond to the nuisance condition, wherein when the sensor detects at a second time after the first time at least one second environmental property that is outside of the acceptable range, the processor is configured to compare the at least one second environmental property with the nuisance environmental properties, and the processor is configured to suppress alerts from the alarm based on the comparison.

2. The alarm of claim 1, wherein the processor is configured to compare the detected environmental properties with a plurality the nuisance environmental properties.

3. The alarm of claim 1, wherein the nuisance environmental properties include a property selected from the group consisting of gas concentration, gas composition, humidity, and temperature.

4. The alarm of claim 1, wherein the nuisance environmental properties include smoke concentration and composition.

5. The alarm of claim 1, wherein the processor is operative to override suppression of the alerts in the presence of detected environmental properties detected at a third time after the second time outside of a predetermined range.

6. A learning alarm system, comprising:

a processor operatively connected to at least two alarm units, each alarm unit including a sensor to detect environmental properties;

an alarm operatively connected to the processor to provide an alert if environmental properties are outside an acceptable range, including at least one first environmental property detected at a first time associated with a first alert;

a user interface operatively connected to the processor to accept user input indicating that the first alert corresponds to a nuisance condition; and a memory operatively connected to the processor for storing in response to receipt of the user input the at least one first environmental property as nuisance environmental properties that correspond to the nuisance condition, wherein when any of the sensors detects at a second time after the first time at least one second environmental property that is outside of the acceptable range, the processor is configured to compare the at least one second environmental property with the nuisance environmental property, and the processor is configured to suppress alerts from the alarm based on the comparison.

7. The system of claim 6, wherein the processor is configured to compare the detected environmental properties with a plurality of the nuisance environmental properties.

8. The system of claim 6, wherein the nuisance environmental properties include a property selected from the group consisting of gas concentration, gas composition, humidity, and temperature.

9. The system of claim 6, wherein the nuisance environmental properties include smoke concentration and composition.

10. The system of claim 6, wherein the processor is operative to override suppression of the alerts in the presence of detected environmental properties detected at a third time after the second time outside of a predetermined range.

11. A method of suppressing nuisance alarms, comprising:

detecting environmental properties;

providing an alert if environmental properties are outside an acceptable range, including at least one first environmental property detected at a first time associated with a first alert;

receiving user input indicating that the first alert corresponds to a nuisance condition;

storing in response to receipt of the user input the at least one first environmental property as nuisance environmental properties that correspond to the nuisance condition;

detecting, at a second time after the first time, at least one second environmental property that is outside of the acceptable range;

comparing the at least one second environmental property with the nuisance environmental properties; and suppressing an alert based on the comparison.

12. The method as recited in claim 11, further comprising comparing, when the sensor detects environmental properties that are outside of the acceptable range, the detected environmental properties to the nuisance environmental properties, wherein suppressing the alert is based on the comparison, and wherein the step of comparing includes comparing a slope of a curve of the environmental properties detected at the first time and a slope of a curve of the nuisance environmental properties detected at the second time.

13. The method as recited in claim 11, further comprising comparing, when the sensor detects, at a third time after the second time, environmental properties that are outside of the acceptable range, the detected environmental properties to the nuisance environmental properties, wherein suppressing the alert is based on the comparison, and wherein the step of comparing includes comparing a rate of rise of the detected environmental properties and a rate of rise of the nuisance environmental properties.

14. The method as recited in claim 11, further comprising comparing, when the sensor detects, at a third time after the second time, environmental properties that are outside of the acceptable range, the detected environmental properties to the nuisance environmental properties, wherein suppressing the alert is based on the comparison, and wherein the step of comparing includes comparing a shape of a curve of the second environmental properties and a shape of a curve of the nuisance environmental properties using curve fitting techniques.

15. The method of claim 11, wherein the environmental properties include a property selected from the group consisting of gas concentration, gas composition, humidity, and temperature.

16. The method as recited in claim 11, wherein the environmental properties include smoke concentration and composition.

17. The method as recited in claim 11, further comprising:

overriding suppression of the alert when the detected environmental properties are outside a predetermined range.

* * * * *